US008963039B2

(12) United States Patent
Ohda et al.

(10) Patent No.: US 8,963,039 B2
(45) Date of Patent: Feb. 24, 2015

(54) GAS CIRCUIT BREAKER

(71) Applicants: Yoshiaki Ohda, Kanagawa-ken (JP); Akira Shimamura, Kanagawa-ken (JP); Ryusuke Ochiai, Kanagawa-ken (JP); Satoshi Marushima, Kanagawa-ken (JP)

(72) Inventors: Yoshiaki Ohda, Kanagawa-ken (JP); Akira Shimamura, Kanagawa-ken (JP); Ryusuke Ochiai, Kanagawa-ken (JP); Satoshi Marushima, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 130 days.

(21) Appl. No.: 13/654,809

(22) Filed: Oct. 18, 2012

(65) Prior Publication Data

US 2013/0098875 A1 Apr. 25, 2013

(30) Foreign Application Priority Data

Oct. 21, 2011 (JP) ..... 2011-232279

(51) Int. Cl.

*H01H 3/00* (2006.01)
*H01H 33/00* (2006.01)
*H01H 33/70* (2006.01)
(Continued)

(52) U.S. Cl.

CPC ..... *H01H 33/30* (2013.01); *H01H 33/42* (2013.01); *H01H 33/50* (2013.01); *H01H 33/565* (2013.01); *H01H 33/40* (2013.01); *H01H 33/91* (2013.01)
USPC ..... 218/154; 218/47; 218/50; 218/78; 218/84; 218/143

(58) Field of Classification Search

CPC ..... H01H 3/00
USPC ..... 128/13, 26, 42, 46, 47, 84, 90, 154, 128/155; 218/13, 26, 42, 46, 47, 84, 90, 218/154, 155, 14
See application file for complete search history.

(56) References Cited

U.S. PATENT DOCUMENTS 5,604,340 A * 2/1997 Yamada et al. ..... 218/143
6,667,452 B2 * 12/2003 Spiegel ..... 200/501

FOREIGN PATENT DOCUMENTS

JP 1896131 1/1995
JP 963425 7/1997
(Continued)

OTHER PUBLICATIONS

JP, 09-063425, machine english translation attached.*
(Continued)

*Primary Examiner* — Renee Luebke
*Assistant Examiner* — William Bolton
(74) *Attorney, Agent, or Firm* — Baker Botts L.L.P.

(57) ABSTRACT

A gas circuit breaker includes movable and fixed electrode parts arranged to face each other in an engaging/separating manner in a container filled with an insulating gas, an operating mechanism attached to a partition of the container and configured to output an operating force to the movable electrode part, an operating rod attached to the movable electrode part, a first link rotatably attached to the operating rod, a lever rotatably attached to the first link, a support bearing fixed to the partition of the container via an insulating spacer, a second link rotatably attached to the lever and also rotatably attached to the support bearing, a seal bearing connected through the partition of the container, a seal rod rotatably attached to the center of the lever and slidably supported to the seal bearing, and a third link rotatably attached to the seal rod and also attached to the operating mechanism.

9 Claims, 12 Drawing Sheets

(51) Int. Cl.

| | |
|---|---|
| ***H01H 33/04*** | (2006.01) |
| ***H01H 33/16*** | (2006.01) |
| ***H01H 33/30*** | (2006.01) |
| ***H01H 33/42*** | (2006.01) |
| ***H01H 33/50*** | (2006.01) |
| ***H01H 33/56*** | (2006.01) |
| *H01H 33/40* | (2006.01) |
| *H01H 33/91* | (2006.01) |

(56) References Cited

FOREIGN PATENT DOCUMENTS

| | | |
|---|---|---|
| JP | 3538274 | 7/1997 |
| JP | 2000-003643 A | 1/2000 |

OTHER PUBLICATIONS

JP, 09-190743, machine english translation attached.*

* cited by examiner

GAS CIRCUIT BREAKER

CROSS-REFERENCE TO RELATED APPLICATION(S)

This application is based upon and claims the benefit of priority from Japan Patent Application(s) No. 2011-232279, filed on Oct. 21, 2011, the entire contents of which are incorporated herein by reference.

TECHNICAL FIELD

The present disclosure relates to a gas circuit breaker including rods and links to transfer an operating force of an operating mechanism to a movable electrode part.

BACKGROUND

A gas circuit breaker of a puffer type or the like is used for a gas-insulated switchgear installed in a substation or a switching station. The gas circuit breaker includes a container air-tightly filled with an insulating gas, in which a fixed electrode part and a movable electrode part are arranged to face each other in an engaging/separating manner under the insulating gas atmosphere. The gas circuit breaker further includes an operating mechanism outside the container, i.e., in the air. The operating mechanism refers to a mechanism to operate the movable electrode part by transferring an operating force to the movable electrode part in the container.

The gas circuit breaker further includes a plurality of rotatable links and linearly movable rods configured to transfer and convert a displacement output, which is an operating force of the operating mechanism, to a displacement of the movable electrode part. In addition, if the displacement output from the operating mechanism is shorter than the displacement of the movable electrode part, a lever to amplify the displacement output from the operating mechanism may be connected to the rods. The connection of the lever to the rods makes it possible to secure a movement stroke of the rods by shaking of the lever.

An operating rod and a seal rod may be used as a linearly movable rod. The operating rod is a rod configured to provide a driving force to the movable electrode part and may be arranged in its entirety in the container.

On the other hand, the seal rod is a rod configured to penetrate through a partition of the container and may be slidably attached to a seal bearing (having a gas sealing function) fixed to the partition of the container.

The conventional gas circuit breaker has the following problems. In this gas circuit breaker, since the combination of rotatable links and linearly movable rods is used to transfer the operating force of the operating mechanism to the movable electrode part, a component force is generated in an operating axial line of the rods in a direction perpendicular to a movement direction of the rods.

In particular, when the displacement amplification lever is connected to the rods, a large component force is generated since an inertial force of the lever is heavily loaded on the rods. This component force exerts on a portion slidably supporting the rods to increase a frictional force exerted on the rods, which results in a low operating speed of the rods.

In addition, a bending stress may act on the rods due to the component force, which may result in a deformation of the rods. For the purpose of avoiding such rod deformation, a sectional area (section modulus) of the rods tends to be large.

However, such upsizing of the rods increases weight of the rods in proportion, which causes the operating speed of the rods to be lower.

It is essential to secure a certain level of operating speed of the rods since it has a direct effect on an opening speed of the gas circuit breaker. Accordingly, a large-scaled operating mechanism consuming more driving energy has been conventionally employed in order to secure the operating speed of the rods. However, such large scaling of the operating mechanism leads to increase in costs and size of the entire gas circuit breaker.

DETAILED DESCRIPTION (1) First Embodiment

Figure 1:
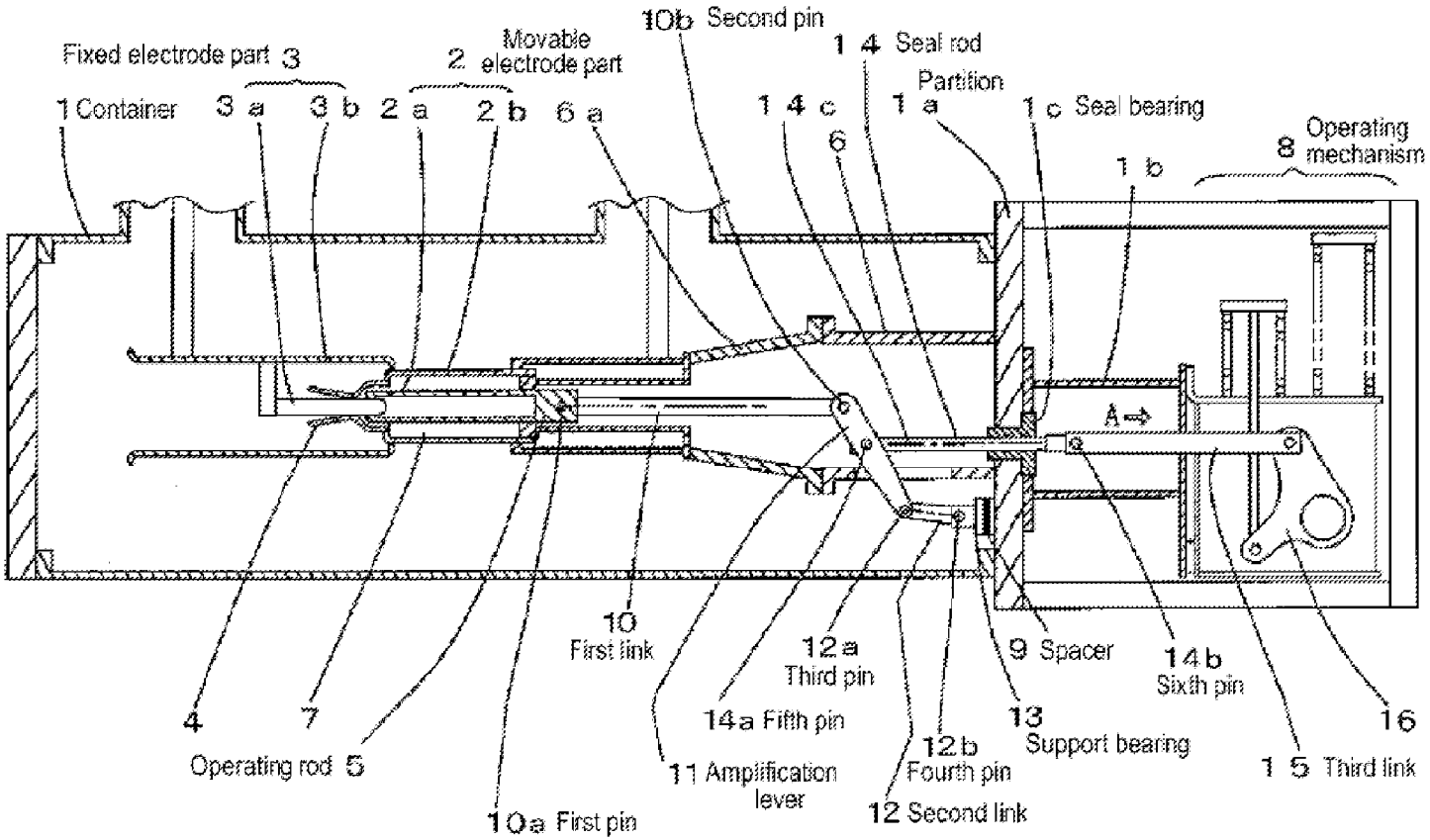
FIG. 1 is a sectional view showing a closing state in accordance with a first embodiment.
Figure 2:
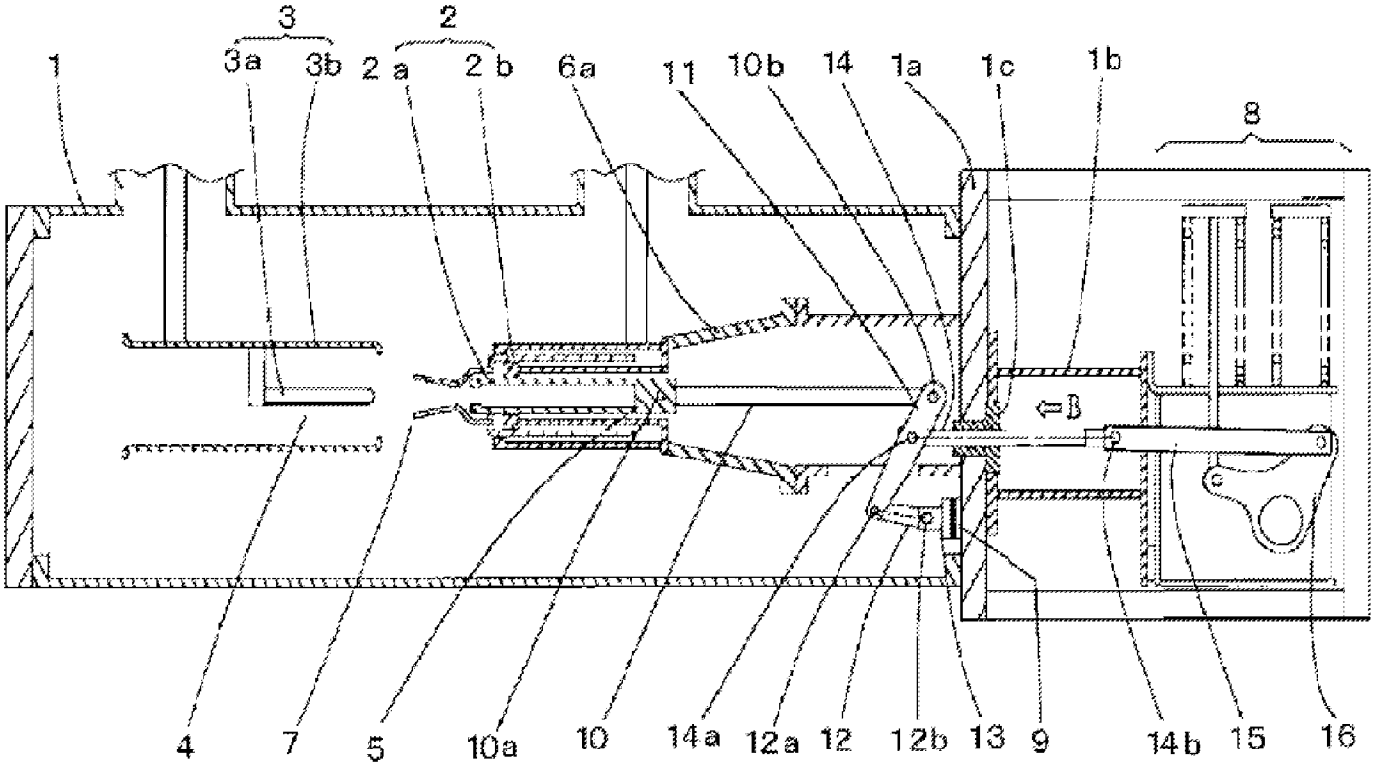
FIG. 2 is a sectional view showing an opening state in accordance with the first embodiment.
Figure 3:
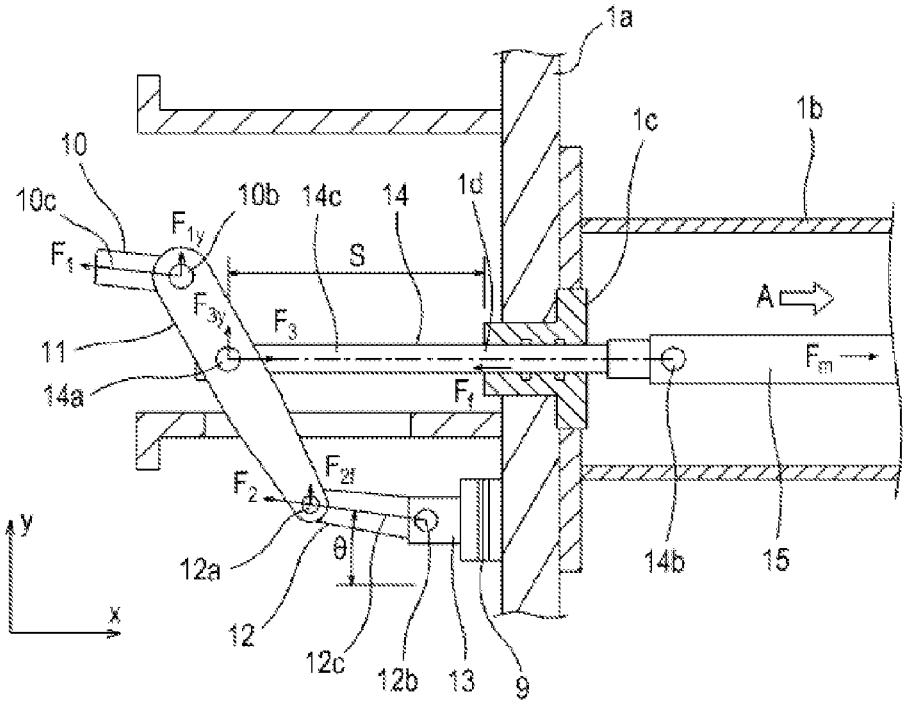
FIG. 3 is a partial-enlarged sectional view of FIG. 1.
Figure 4:
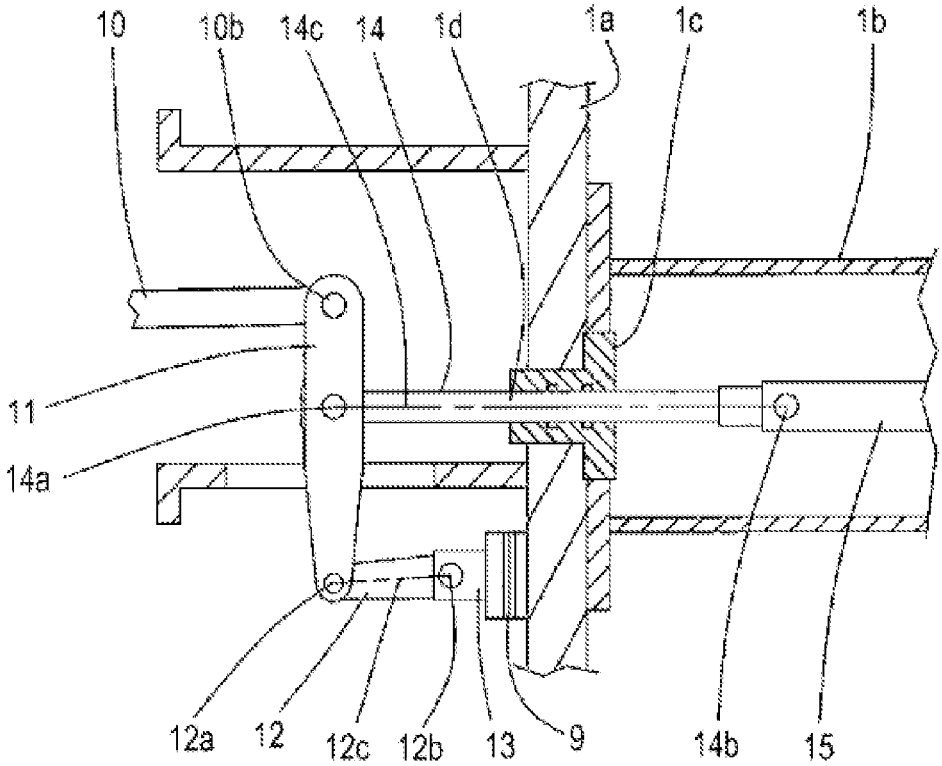
FIG. 4 is a partial-enlarged view showing an intermediate position between the closing state and the opening state.
Figure 5:
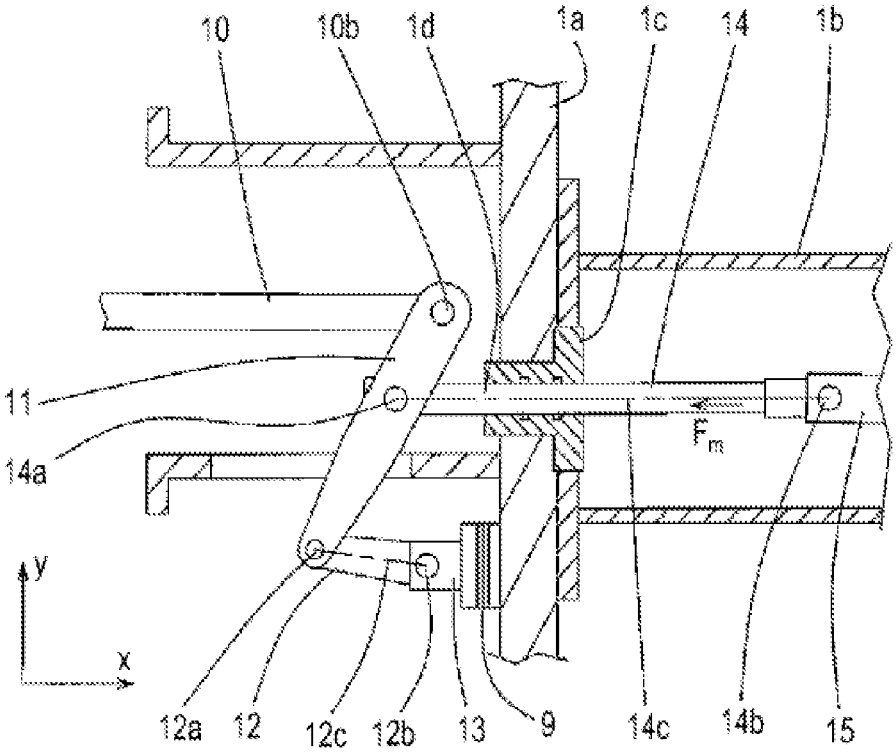
FIG. 5 is a partial-enlarged sectional view of FIG. 2.

A puffer type gas circuit breaker in accordance with a first embodiment will be described with reference to FIGS. 1 to 10. FIGS. 1 and 2 show a closing state and an opening state of the gas circuit breaker, respectively. FIGS. 3 to 5 are partial-enlarged views of a link mechanism assembled in the gas circuit breaker, showing the closing state, an intermediate state between the closing state and the opening state, and the opening state, respectively. FIGS. 6 to 10 are graphs for explaining operation and effects of the first embodiment.

(Outline of Gas Circuit Breaker)

As shown in FIGS. 1 and 2, the gas circuit breaker in accordance with the first embodiment includes a container 1 air-tightly filled with an insulating gas, in which a movable electrode part 2 and a fixed electrode part 3 are arranged to face each other and engaging/separating manner.

The movable electrode part 2 includes a movable arc electrode 2*a* and a movable main electrode 2*b* and the fixed electrode part 3 includes a fixed arc electrode 3*a* and a fixed main electrode 3*b*. According to an operation of the movable electrode part 2, the movable main electrode 2*b* is brought in contact with or separated from the fixed main electrode 3*b* and the movable arc electrode 2*a* is brought in contact with or separated from the fixed arc electrode 3*a*.

A support part 6 is fixed at the inner side of a partition 1*a* of the container 1 (at a side under the insulating gas atmosphere). An insulator 6*a* for electrical insulation is provided in a portion of the support part 6. A mechanism support 1*b* is fixed at the outer side of the partition 1*a* of the container 1 (at a side filled with the air). In addition, a seal bearing 1*c* having a gas seal function is provided in the partition 1*a* of the container 1.

(Operating Mechanism)

An operating mechanism 8 is disposed on the mechanism support 1*b* of the container 1. The operating mechanism 8 is a mechanism to operate the movable electrode part 2 by providing an operating force to the movable electrode part 2. An elastic body such as a spring or the like, or hydraulic system is used as the operating mechanism 8. The operating mechanism 8 includes a rotatable output part 16 to output the operating force.

(Movable Electrode Part)

The movable electrode part 2 is riveted with an insulating nozzle 4 and includes a pressurizing chamber 7 to pressurize the insulating gas. The pressurizing chamber 7 is configured to blow out the insulating gas from between the movable arc electrode 2*a* and the insulating nozzle 4 according to an opening operation by compressing the internal insulating gas.

The gas circuit breaker according to the first embodiment includes two rods 5 and 14, three links 10, 12 and 15, and an amplification lever 11 to amplify a displacement, all of which are members configured to transfer the operating force of the operating mechanism 8 to the movable electrode part 2. These members are interconnected by six pins 10*a*, 10*b*, 12*a*, 12*b*, 14*a* and 14*b*.

The rods, the lever and the links are arranged in a direction from the movable electrode part 2 side toward the operating mechanism 8 side in order of the operating rod 5, the first link 10, the amplification lever 11, the second link 12, the seal rod 14 and the third link 15. In the following description regarding the rods and links included in a link mechanism, an end near the movable electrode part 2 is referred to as a "front end" and an end near the operating mechanism 8 is referred to as a "rear end".

The operating rod 5 is slidably supported by the support part 6 of the partition 1*a* of the container 1. The front end of the operating rod 5 is riveted to the movable electrode part 2. The first pin 10*a* is attached to the rear end of the operating rod 5 and the front end of the first link 10 is rotatably connected through the first pin 10*a*.

The second pin 10*b* is attached to the rear end of the first link 10 and the top of the amplification lever 11 is rotatably connected through the second pin 10*b*. That is, the first pin 10*a* and the second pin 10*b* are respectively attached to both ends of the first link 10. Further, the operating rod 5 and the first link 10 are interconnected by the first pin 10*a*, and the first link 10 and the amplification lever 11 are interconnected by the second pin 10*b*.

The third pin 12*a* is attached to the bottom of the amplification lever 11, and the front end of the second link 12 is rotatably connected through the third pin 12*a*. The fourth pin 12*b* is attached to the rear end of the second link 12, and the support bearing 13 is connected by the fourth pin 12*b*. The support bearing 13 is a member to support the second link 12 and is fixed to the inner side of the partition 1*a* of the container 1, with an insulating spacer 9 interposed therebetween. The second link 12 includes the third pin 12*a* and the fourth pin 12*b*, which are respectively attached to both ends of the second link 12. Further, the amplification lever 11 and the second link 12 are interconnected by the third pin 12*a*, and the second link 12 and the support bearing 13 are interconnected by the fourth pin 12*b*.

While the second pin 10*b* and the third pin 12*a* are respectively attached to the top and bottom of the amplification lever 11 as described above, the fifth pin 14*a* is attached to the substantial center of the amplification lever 11. Accordingly, three pins 10*b*, 12*a* and 14*a* are attached to the amplification lever 11, connected with the first link by the second pin 10*b*, connected with the second link 12 by the third pin 12*a*, and rotatably connected with the front end of the seal rod 14 by the fifth pin 14*a*.

The front end of the third link 15 is rotatably connected to the rear end of the seal rod 14 through the sixth pin 14*b*. That is, the fifth pin 14*a* and the sixth pin 14*b* are respectively attached to both ends of the seal rod 14. Further, the amplification lever 11 is connected by the fifth pin 14*a*, and third link 15 is connected by the sixth pin 14*b*. In addition, the seal rod 14 is slidably connected to the center of the seal bearing 1*c* in the partition 1*a* of the container. In addition, the output part 16 of the operating mechanism 8 is connected to the rear end of the third link 15.

A positional relationship between the first link 10, the amplification lever 11 and the seal rod 14 will be now described with reference to FIGS. 1 to 5. A straight line connecting the centers of the second pin 10*b* and first pin 10*a* (shown in FIGS. 1 and 2) engaged with the first link 10 is defined as a first straight line 10*c* (shown in FIG. 3). When the movable electrode part 2 and the fixed electrode part 3 are in the closing state, the first straight line 10*c* and an operating axial line 14*c* extending in a sliding direction of the seal rod 14 are set to be substantially in parallel or intersect at the seal rod 14 side when viewed from the amplification lever 11, as shown in FIG. 3.

The second link 12, the amplification lever 11 and the seal rod 14 are configured to have the following positional relationship with one another. As shown in FIGS. 3 to 5, a straight line connecting the centers of the fourth pin 12*b* and third pin 12*a* included in the second link 12 is defined as a second straight line 12*c*. When the movable electrode part 2 and the fixed electrode part 3 are in the closing state, the second straight line 12*c* and the operating axial line 14*c* of the seal rod 14 are set to be substantially in parallel or intersect at the operating rod 5 side when viewed from the amplification lever 11.

An angle made between the second straight line 12*c* on the second link 12 and the operating axial line 14*c* of the seal rod 14 in the closing state is defined as a support link initial angle θ. The support link initial angle θ has a positive value for left rotation with respect to a straight line in parallel to the operating axial line 14*c*. In the first embodiment, the first link 10, the second link 12, the amplification lever 11 and the seal rod 14 satisfy the above positional relationship, and the support link initial angle θ is set to a range of −2 degrees to 0 degrees. The reason for setting the support link initial angle to this range will be described in detail later with reference to graphs of FIGS. 6 to 10.

(Opening Operation)

For the opening operation in the first embodiment, a process from the closing state shown in FIG. 1 to the opening state shown in FIG. 2 will be described below. In the closing state shown in FIG. 1, when the operating mechanism 8 receives an opening command from the external, the output part 16 is rotated to move the third link 15 connected to the output part 16 in a direction indicated by an arrow A.

The seal rod 14 connected to the third link 15 is also moved in the arrow A direction and the amplification lever 11 connected to the seal rod 14 is clockwise rotated around the third pin 12*a*. As the amplification lever 11 is rotated, the first link 10 connected to the amplification lever 11 is moved in the arrow A direction, and the operating rod 5 and the movable electrode part 2 connected thereto are also moved in the arrow A direction. The movable electrode part 2 is separated from the fixed electrode part 3 through the above-described movement process.

The operation of the neighborhood of the amplification lever 11 transitions from the closing state shown in FIG. 3 to the opening state shown in FIG. 5 via an intermediate position shown in FIG. 4. Once the output part 16 of the operating mechanism 8 has completed the movement of the third link 15 by a predetermined distance, such movement of the third link 15 is also transferred to the movable electrode part 2, thereby completing the opening operation. In addition, a ratio between the displacement of the seal rod 14 and the displacement of the operating rod 5 is in proportion to a ratio between a distance between the third pin 12*a* and the fifth pin 14*a* and a distance between the third pin 12*a* and the second pin 10*b*.

(Force Exerted on Each Component in Opening Operation)

As a force exerted on each component when the opening operation starts, an operating force $F_m$ of the operating mechanism 8 is exerted in an opening direction indicated by an arrow A, as shown in FIG. 3. When the operating force $F_m$ is applied to the seal rod 14 via the third link 15, a force $F_3$ along the operating axial line 14*c* of the seal rod 14 and a force $F_{3y}$ in a direction perpendicular to the operating axial line 14*c* are exerted on the fifth pin 14*a* near the center of the amplification lever 11. Here, the direction of the operating axial line 14*c* is represented by an x axis and the perpendicular direction thereof is represented by a y axis.

In addition, in the top of the amplification lever 11, a force $F_1$ resulting from an inertia force of the movable electrode part 2 and a pressure of the insulating gas compressed in the pressurizing chamber 7 is exerted on the second pin 10*b* attached to the first link 10. In the closing state, the first straight line 10*c* along the first link 10 intersects the operating axial line 14*c* of the seal rod 14 at the seal rod 14 side when viewed from the amplification lever 11.

When the seal rod 14 moves to the arrow A direction, the linear movement of the seal rod 14 is substantially maintained, because the seal rod 14 is supported by the seal bearing 1*c*. In this case, when the amplification lever 11 is rotated around the third pin 12*a*, the linear movement of the seal rod 14 is restrained. Therefore, when the seal rod 14 moves straight, the fifth pin 14*a* which connects the amplification lever 11 and the seal rod 14 moves to follow the linear movement of the seal rod 14 by the shake of the amplification lever 11 caused by the infinitesimal shake of the second link 12. That is, when the seal rod 14 moves to the arrow A direction, the amplification lever 11 is rotated around the fifth pin 14*a* with the infinitesimal shake. Therefore, the radius of rotation of the second pin 10*b* in the case of the amplification lever 11 is rotated around the fifth pin 14*a* is shorter than the one in the case of the amplification lever 11 is rotated around the third pin 12*a*. The difference of them is the distance between the fifth pin 14*a* and the third pin 12*a*. For these reasons, a y-axial component of the displacement of the first link 10 (a y-axial component of the displacement of the second pin 10*b*) is reduced. Accordingly, a y-axial component $F_{1y}$ of the force $F_1$ applied to the first link 10 may be kept small.

In addition, in the bottom of the amplification lever 11, a force $F_2$ along the second straight line 12*c* is exerted on the third pin 12*a* attached to the second link 12. In the closing state, the second straight line 12*c* along the second link 12 is substantially in parallel to or intersects the operating axial line 14*c* of the seal rod 14 at the operating rod 5 side when viewed from the amplification lever 11. When the seal rod 14 moves to the arrow A direction, the linear movement of the seal rod 14 is substantially maintained, because the seal rod 14 is supported by the seal bearing 1*c*. In this case, when the amplification lever 11 is rotated around the third pin 12*a*, the linear movement of the seal rod 14 is restrained. Therefore, when the seal rod 14 moves straight, the second link 12 is infinitesimal shaken in order to absorb a y-axial component of the displacement of the amplification lever 11 caused by the rotation of the amplification lever 11 around the third pin 12*a*. As mentioned above, when the seal rod 14 moves to the arrow A direction, the amplification lever 11 rotates around the fifth pin 14*a* with the infinitesimal shake. Therefore, the radius of rotation of the third pin 12*a* is the distance between the fifth pin 14*a* and the third pin 12*a*. Because the fifth pin 14*a* is located in the approximate center of the amplification lever 11, a y-axial component of displacement of the second link 12 (the third pin 12*a*) and a y-axial component of displacement of the first link 10 can be deemed approximately same. Accordingly, like the first link 10, a displacement of the second link 12 in a vertical direction is reduced even when the amplification lever 11 is shaken. As a result, a y-axial component $F_{2y}$ of the force $F_2$ applied to the second link 12 may be kept small.

The vertical force $F_{3y}$ exerted near the center of the amplification lever 11 corresponds to the sum of the force $F_{1y}$ exerted on the top of the amplification lever 11 and the force $F_{2y}$ exerted on the bottom of the amplification lever 11, i.e., a relationship of $F_{3y}=F_{1y}+F_{2y}$ is established. In the first embodiment, since both of the forces $F_{1y}$ and $F_{2y}$ are small, the vertical force $F_{3y}$ is small accordingly.

In FIGS. 3 to 5, reference numeral 1*d* denotes a sliding support to the seal rod 14. Assuming that a distance from the center of the fifth pin 14*a* located in the center of the amplification lever 11 to the sliding support 1*d* is S, a bending moment M exerted on the seal rod 14 at the sliding support 1*d* can be obtained according to an equation of $M=F_{3y}\cdot S$. A bending stress $\sigma$ of the seal rod 14 is accordingly obtained according to an equation of $\sigma=M/Z$ (where Z is a section modulus of the seal rod 14).

For a frictional force $F_f$ between the seal bearing 1*c* and the seal rod 14, assuming that a frictional coefficient is $\mu$, a relationship of $F_f=\mu\cdot F_{3y}$ is established. At this time, if the frictional force $F_f$ is large, a resistance in the opening operation is increased, which results in decrease in an opening speed. Thus, in order to make the frictional force $F_f$ small while keeping the frictional coefficient $\mu$ constant, it is important to make the vertical force $F_{3y}$ small with respect to the operating axial line 14*c*.

In addition, since the support link initial angle $\theta$ refers to the angle made between the second straight line 12*c* and the operating axial line 14*c* of the seal rod 14 in the closing state, the direction of the force $F_2$ along the second straight line 12*c* is changed by the support link initial angle $\theta$. The y-axial component $F_{2y}$ of the force $F_2$ is a factor to determine the vertical force $F_{3y}$. Accordingly, the size of the support link initial angle $\theta$ has an effect on the vertical force $F_{3y}$.

Figure 6:
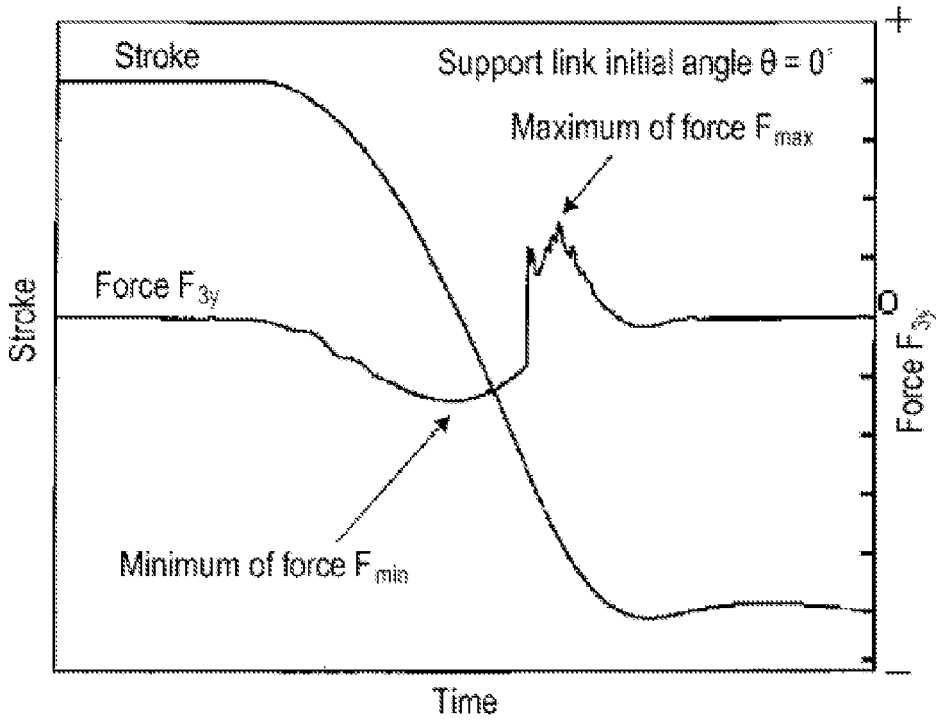
FIG. 6 is a graph showing results of calculating a stroke of a movable electrode part and a force $F_{3y}$ in the opening state in a case where a support link initial angle θ is set to 0 degrees.

The effect of the support link initial angle $\theta$ on the vertical force $F_{3y}$ will be described below with reference to FIGS. 6 and 7. FIG. 6 shows results of calculating a stroke of the movable electrode part 2 and the vertical force $F_{3y}$ in the opening state of the gas circuit breaker over time. Here, the support link initial angle $\theta$ is set to 0 degrees. When the opening operation of the gas circuit breaker is started, an absolute value of the vertical force $F_{3y}$ slowly increases from zero and the direction of the vertical force $F_{3y}$ is reversed by an action of a brake (not shown) in the operating mechanism 8 in the second half of the opening operation. Thereafter, when the opening operation of the gas circuit breaker is completed, the vertical force $F_{3y}$ returns to zero.

Figure 7:
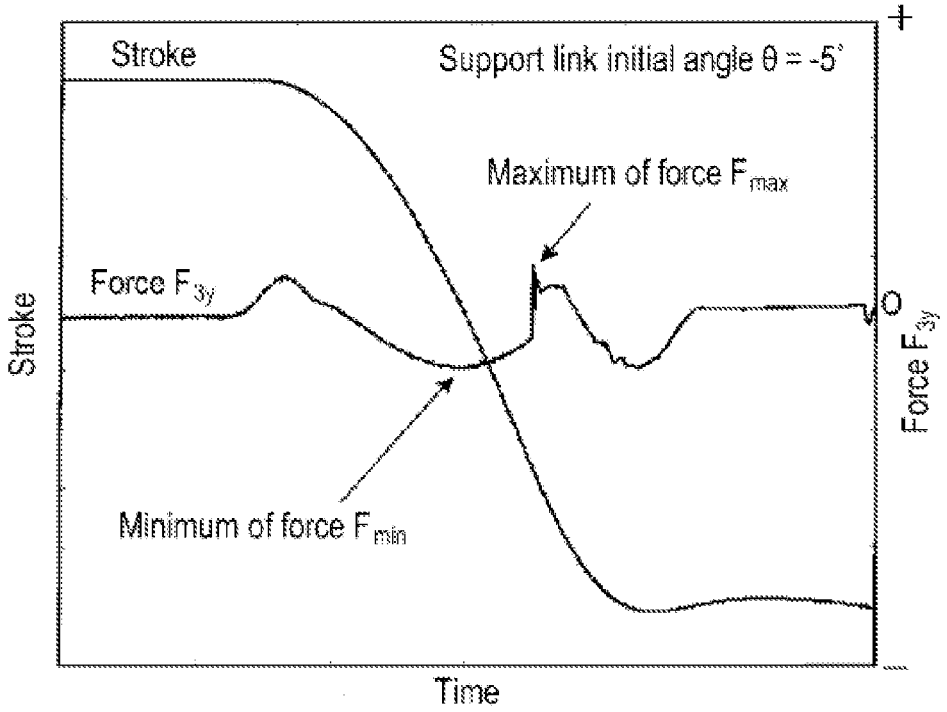
FIG. 7 is a graph showing results of calculating a stroke of a movable electrode part and a force $F_{3y}$ in the opening state in a case where a support link initial angle θ is set to −5 degrees.

FIG. 7 is a graph showing results of calculating a stroke of the movable electrode part 2 and the vertical force $F_{3y}$ in the opening operation over time in a case where the support link initial angle θ is set to −5 degrees. In comparison with FIG. 6, it can be seen from FIG. 7 that the vertical force $F_{3y}$ is changed from zero to positive at the start of the opening operation, and thereafter, slowly decreases.

As shown in FIGS. 6 and 7, assuming that the maximum and minimum of the vertical force $F_{3y}$ are $F_{max}$ and $F_{min}$, respectively, their smaller absolute values provide a smaller frictional force $F_f$ of the seal rod 14. Accordingly, when the support link initial angle θ is set so that the frictional force $F_f$ of the seal rod 14 decreases, the seal rod 14 can secure a high operating speed, thereby preventing an opening speed of the gas circuit breaker from decreasing.

Figure 8:
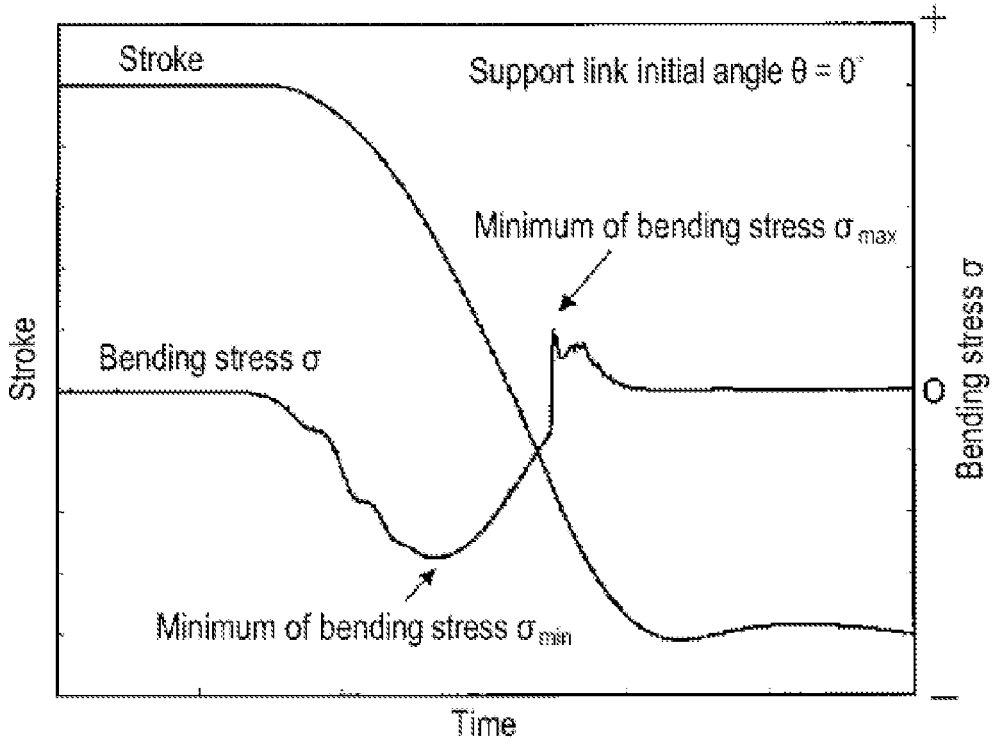
FIG. 8 is a graph showing results of calculating a stroke of a movable electrode part and a bending stress σ of a seal rod in the opening state in a case where a support link initial angle θ is set to 0 degrees.

In addition, the support link initial angle θ has the effect on the vertical force $F_{3y}$, which means that it also has an effect on the bending stress σ of the seal rod 14, as will be described below with reference to FIGS. 8 and 9. FIG. 8 shows results of calculating a stroke of the movable electrode part 2 and the bending stress σ of the seal rod 14 in the opening operation of the gas circuit breaker. Here, the support link initial angle θ is set to 0 degrees. When the opening operation of the gas circuit breaker is started, an absolute value of the bending stress σ slowly increases from zero and the direction of the bending stress σ is reversed by an action of the brake (not shown) in the operating mechanism 8 in the second half of the opening operation. Thereafter, when the opening operation of the gas circuit breaker is completed, the bending stress σ returns to zero.

Figure 9:
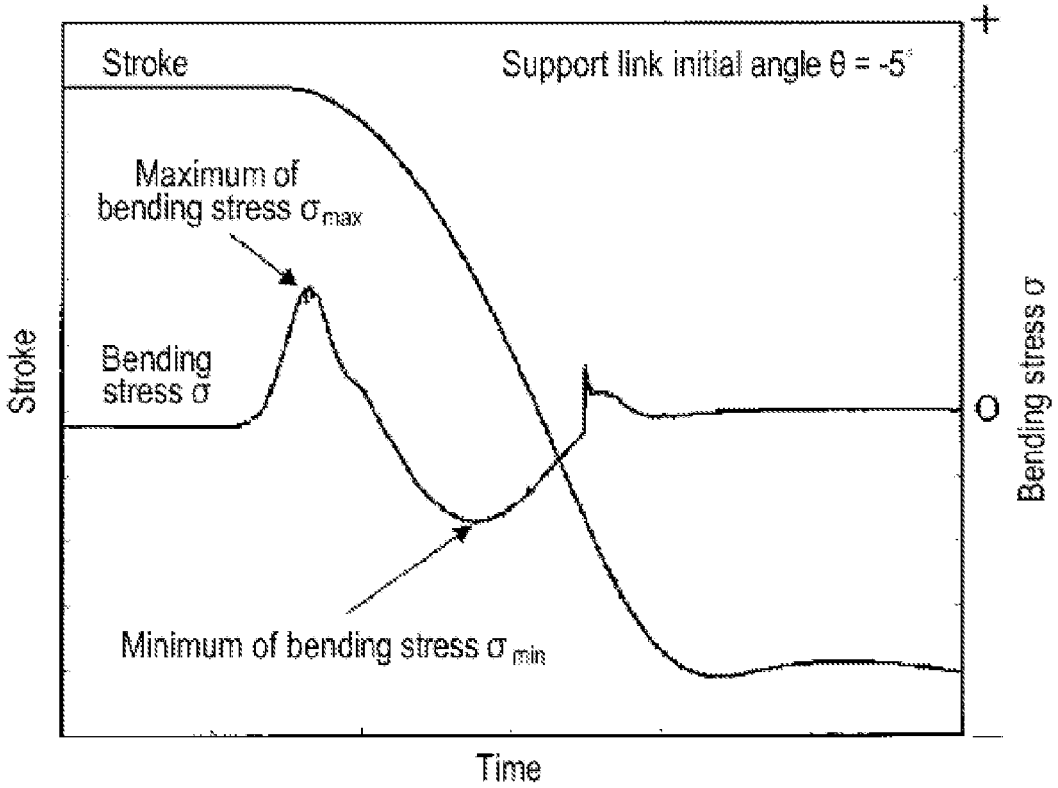
FIG. 9 is a graph showing results of calculating a stroke of a movable electrode part and a bending stress σ of a seal rod in the opening state in a case where a support link initial angle θ is set to −5 degrees.

FIG. 9 shows results of calculating a stroke of the movable electrode part 2 and the bending stress σ of the seal rod in the opening operation in a case where the support link initial angle θ is set to −5 degrees. As illustrated in FIG. 9 in comparison with FIG. 8, the bending stress σ is changed from zero to positive at the start of the opening operation, and thereafter, slowly decreases. Here, as shown in FIG. 8, assuming that the maximum and minimum of the bending stress σ are $\sigma_{max}$ and $\sigma_{min}$, respectively, their smaller absolute values provide a larger strength of the seal rod 14. Accordingly, when the support link initial angle θ is set so that the absolute values of the maximum and minimum of the bending stress σ decrease, the seal rod 14 can achieve high strength, downsizing and weight reduction.

Figure 10:
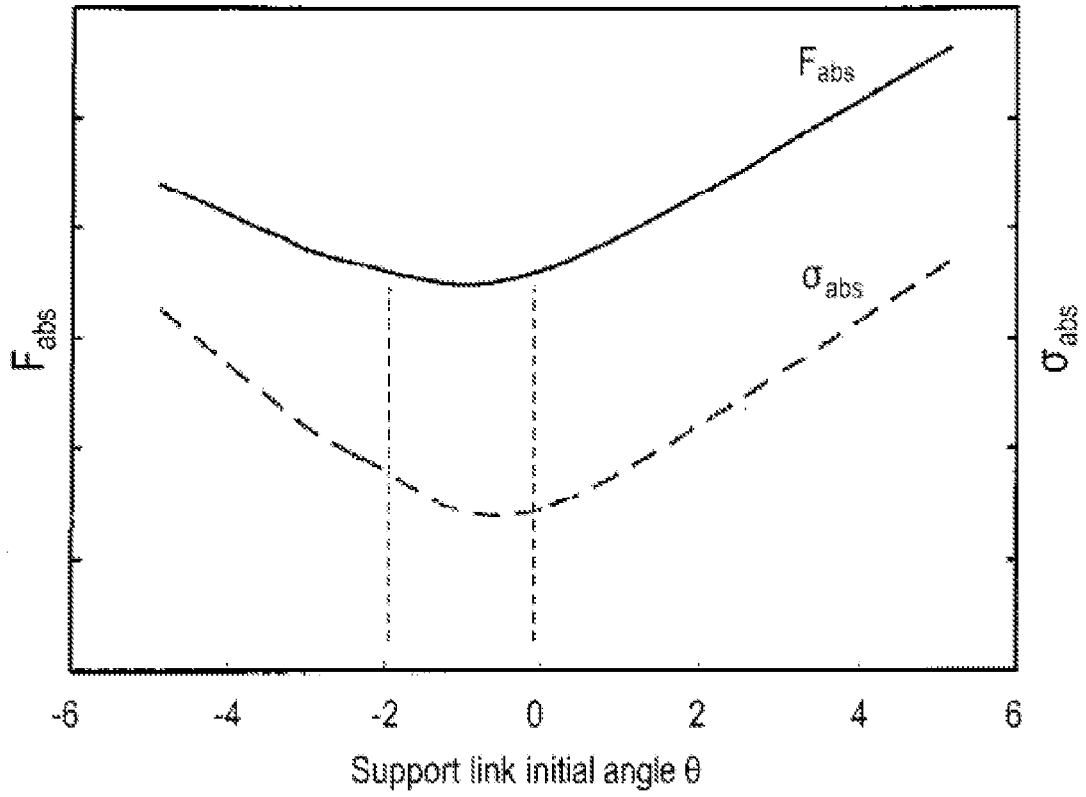
FIG. 10 is a graph showing a relationship between a support link initial angle θ and the sum $F_{abs}$ of absolute values of the maximum and minimum of a force $F_{3y}$.

FIG. 10 shows a relationship between the support link initial angle θ and the sum $F_{abs}$ of absolute values of the maximum ($F_{max}$) and minimum ($F_{min}$) of the vertical force $F_{3y}$. FIG. 10 also shows a relationship between the support link initial angle θ and the sum $\sigma_{abs}$ of absolute values of the maximum ($\sigma_{max}$) and minimum ($\sigma_{min}$) of the bending stress σ. As depicted in FIG. 10, there exists a support link initial angle θ providing the smallest $F_{abs}$ and $\sigma_{abs}$. That is, as shown in the graph of FIG. 10, the support link initial angle θ in a range of −2 degrees to 0 degrees provides the smallest $F_{abs}$ and $\sigma_{abs}$. Accordingly, in the first embodiment, the support link initial angle θ is set to be within the providing the range of −2 degrees to 0 degrees.

(Closing Operation)

The closing operation reaching the closing state shown in FIG. 1 from the opening state shown in FIG. 2 will be now described. When the operating mechanism 8 receives a closing command externally in the opening state shown in FIG. 2, the output part 16 is rotated to start movement of the third link 15 connected to the output part 16 in a direction indicated by an arrow B. The seal rod 14 connected to the third link 15 is accordingly moved in the direction of arrow B and the amplification lever 11 is counterclockwise rotated around the third pin 12*a*. The first link 10 is moved in the direction of arrow B by the rotation of the amplification lever 11 and the operating rod 5 and the movable electrode part 2 connected thereto are accordingly moved. In this movement process, the movable electrode part 2 is closed to the fixed electrode part 3.

In addition, in the puffer type gas circuit breaker, a speed and a force of a movable part (including the movable electrode part 2 and the link mechanism) in the closing operation is generally smaller than those in the opening operation. Accordingly, it is sufficient if strength of each constituent member of the link mechanism is designed with the force generated in the opening operation.

[Operation and Effects]

The following is a description on operation and effects of the first embodiment as configured above.

(1) In the first embodiment, the second link 12 is fixed to the partition 1*a* of the container 1 via the support bearing 13. With this configuration, the second link 12 and each member connected thereto can achieve improved operability and hence high operation reliability.

(2) The first embodiment can be implemented without a guide or roller to alleviate the bending stress or a case part or the like attached to the guide for the rods which perform the linear operation. Accordingly, the weight of the rods can be reduced and an operating mechanism 8 consuming less driving energy can be implemented in a compact size. Thus, the gas circuit breaker can be implemented in a compact size as a whole, which reduces the manufacturing cost.

(3) In the first embodiment, the support bearing 13 is attached to the container 1 via the insulating spacer 9. This makes it possible to dispose the second link 12 attached to the support bearing 13 in close proximity to the container 1. This eliminates a need to secure a large insulating gap between the second link 12 and the container 1, which can lead to compactness of the container 1 and hence further compactness of the gas circuit breaker.

(4) Since the operating force from the operating mechanism 8 is reduced by the amplification lever 11, a large operating force may not be directly exerted on the first link 10. This makes it possible to apply an insulating material having a low strength to the first link 10 and improve reliability in terms of mechanical strength.

(5) In the first embodiment, the vertical force $F_{3y}$ exerted on the vicinity of the center of the amplification lever 11 can be reduced, thereby decreasing the frictional force $F_f$ of the seal rod 14 and the bending stress to the seal rod 14. As a result, no deformation occurs even when the seal rod 14 has a small sectional area, which can lead to downsizing and weight reduction of the seal rod 14. This can also lead to an improvement in an operating speed of the seal rod 14.

(6) In addition, in the first embodiment, by setting the support link initial angle θ to a range of −2 degrees to 0 degrees, the frictional force $F_f$ between the seal bearing 1*c* and the seal rod 14 can be minimized to obtain a high opening speed. In addition, it is also possible to reduce the bending stress σ exerted on the seal rod 14, which can lead to a high opening speed of the gas circuit breaker.

(7) In addition, in the first embodiment, since the support bearing 13 is fixed to the partition 1*a* of the container 1 by the spacer 9, it is possible to easily adjust the support link initial angle θ, which is an angle made between the second link 12 and the seal rod 14, by adjusting the thickness of the spacer 9. This can improve the opening speed of the gas circuit breaker.

(2) Second Embodiment

Figure 11:
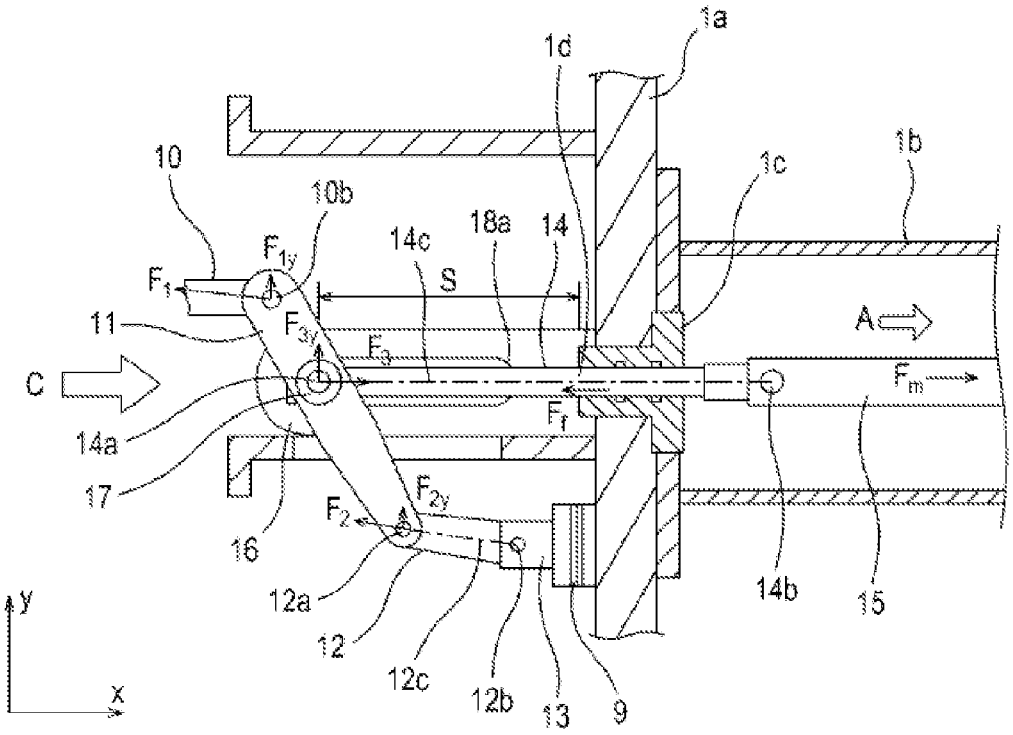
FIG. 11 is a partial-enlarged view showing a closing state in accordance with a second embodiment.
Figure 12:
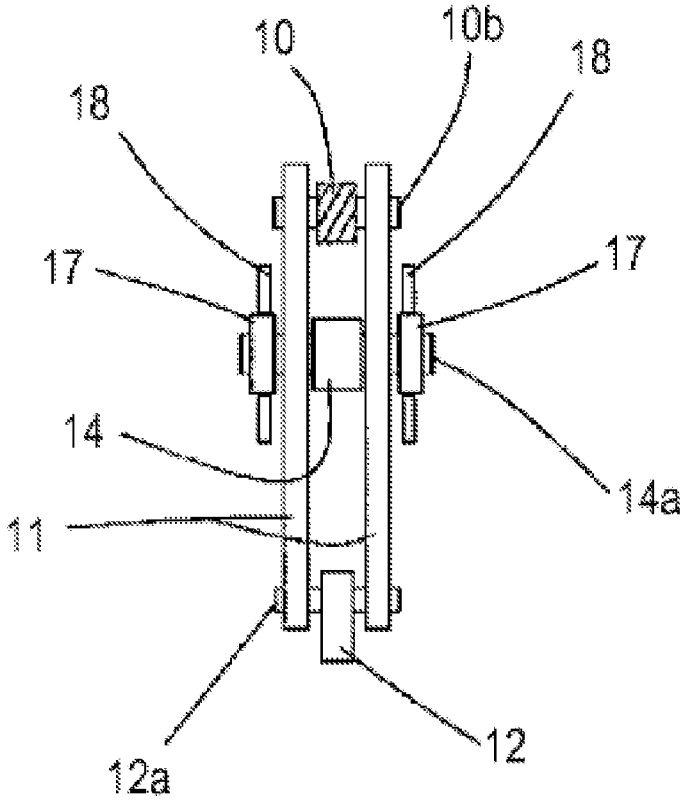
FIG. 12 is a side view of FIG. 11.

A puffer type gas circuit breaker in accordance with a second embodiment will be described with reference to FIGS. 11 and 12. FIG. 11 is a partial-enlarged view of the gas circuit breaker in a closing state and FIG. 12 is a side sectional view taken along a direction indicated by an arrow C in FIG. 11. The same or similar elements as the first embodiment are denoted by the same reference numerals and explanation of which will not be repeated.

[Configuration]

As shown in FIGS. 11 and 12, a guide roller 17 is rotatably attached to the fifth pin 14*a* of the seal rod 14. A guide plate 18 is fixed to the partition 1*a* and has a long opening 18*a* formed therein. The longitudinal direction of the long opening 18*a* is in parallel to the operating axial line 14*c*. The guide roller 17 is slidably inserted in and supported to the long opening 18*a*.

(Opening Operation)

With the second embodiment as configured above, an opening operation from the closing state shown in FIG. 11 will be described below. The guide roller 17 is rotated and moved along the long opening 18*a*, while other constituent members have the same movement as those in the opening operation of the first embodiment. At this time, although the vertical force $F_{3y}$ is delivered to the long opening 18*a* via the guide roller 17, a reaction having the same size as the vertical force $F_{3y}$ is generated from the long opening 18*a*. The closing operation of the second embodiment is similar to that of the first embodiment, which can be easily understood from FIG. 11 and FIGS. 1 to 5 explained above with respect to the first embodiment, and therefore, explanation thereof will not be repeated.

[Operation and Effects]

The second embodiment as configured above has the following operation and effects in addition to the operation and effects of the first embodiment. That is, no bending moment M exerts on the seal rod 14 (i.e., M=0). Accordingly, the bending stress σ of the seal rod 14 also becomes zero. Accordingly, there is no need to make the section modulus Z of the seal rod 14 large, which can lead to further downsizing and weight reduction of the seal rod 14.

In addition, in the second embodiment, no vertical force $F_{3y}$ exerts on the seal bearing 1*c*. Accordingly, the frictional force $F_f$ becomes substantially zero to prevent the opening speed from being decreased due to increase in the frictional force $F_f$. Although a frictional force due to contact between the guide roller 17 and the long opening 18*a* is generated, a rolling friction coefficient is generally less than 1/100 of a sliding friction coefficient. Accordingly, increase in a frictional force due to the rolling is insignificant and thus have little effect on decrease in the opening speed.

In addition, in the second embodiment, the guide roller 17 slidably supporting the seal rod 14 is attached to the fifth pin 14*a* of the seal rod 14, which eliminates a need to make the entire length of the seal rod 14 large due to such addition of the guide structure. In addition, the second embodiment employs the guide plate 18 which can be implemented cost-effectively compared to a cylindrical guide member and the like.

In addition, when the support link initial angle θ described in the first embodiment is appropriately set, the vertical force $F_{3y}$ can be also reduced in the second embodiment. Accordingly, there is no need to strengthen the guide plate 18 and the guide roller 17, which can reduce costs and further lead to reduction of the rolling frictional force. As a result, it is possible to reliably prevent the opening speed of the gas circuit breaker from being decreased.

(3) Other Embodiments

While certain embodiments have been described, these embodiments have been presented by way of example only, and are not intended to limit the scope of the disclosures. Indeed, the novel methods and apparatuses described herein may be embodied in a variety of other forms; furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures. For example, although it has been illustrated in the second embodiment that the guide roller 17 is guided along the long opening 18*a*, the fifth pin 14*a* may be directly guided along the long opening 18*a*.

What is claimed is:

1. A gas circuit breaker comprising:

a movable electrode part and a fixed electrode part which are arranged to face each other in a manner where they engage and separate in a container air-tightly filled with an insulating gas;

an operating mechanism attached to the outer side of a partition of the container and configured to output an operating force from an output part to the movable electrode part;

an operating rod including one end attached to the movable electrode part;

a first link including one end rotatably attached to the operating rod;

a lever including one end rotatably attached to the first link;

a support bearing which is fixed to the partition of the container via an insulating spacer;

a second link including one end rotatably attached to the lever and the other end rotatably attached to the support bearing;

a seal bearing configured to penetrate through the partition of the container;

a seal rod which is rotatably attached to the lever in the vicinity of the center of the lever and is slidably supported to the seal bearing; and a third link including one end rotatably attached to the seal rod and the other end attached to the output part of the operating mechanism.

2. The gas circuit breaker of claim 1, wherein, when the electrode parts are in a closing state, a central line of the first link along a longitudinal direction intersects an operating axial line of the seal rod at the seal rod side with respect to the lever, and a central line of the second link along a longitudinal direction intersects the operating axial line of the seal rod at the operating rod side with respect to the lever.

3. The gas circuit breaker of claim 1, wherein, when the electrode parts are in a closing state, a central line of the first link along a longitudinal direction intersects an operating axial line of the seal rod at the seal rod side with respect to the lever, and a central line of the second link along a longitudinal direction is substantially in parallel to the operating axial line of the seal rod.

4. The gas circuit breaker of claim 1, wherein a guide plate having a long opening is fixed to the partition, a connection pin is attached to a connection portion of the lever and the seal rod, the connection pin is slidably inserted in the long opening of the guide plate, and the longitudinal direction of the long opening coincides with a direction of linear movement of the seal rod.

5. The gas circuit breaker of claim 4, wherein a guide roller is rotatably attached to the connection pin and is slidably connected to the long opening of the guide plate.

6. The gas circuit breaker of claim 1, wherein the first link is made of an insulating material.

7. The gas circuit breaker of claim 1, wherein an insulating spacer is interposed between the support bearing and the partition of the container.

8. The gas circuit breaker of claim 1, wherein an elastic body is used for a driving source of the operating mechanism.

9. The gas circuit breaker of claim 1, wherein a hydraulic system is used for a driving source of the operating mechanism.

* * * * *